US007533879B2

(12) United States Patent
Marasco

(10) Patent No.: US 7,533,879 B2
(45) Date of Patent: May 19, 2009

(54) VARIABLE FREQUENCY TAMPERS FOR COATED STOCKS USED IN PAPER FEED TRAYS

(75) Inventor: Joseph Marasco, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 132 days.

(21) Appl. No.: 11/856,939

(22) Filed: Sep. 18, 2007

(65) Prior Publication Data

US 2009/0072470 A1 Mar. 19, 2009

(51) Int. Cl.
*B65H 3/62* (2006.01)

(52) U.S. Cl. ..... 271/146

(58) Field of Classification Search ..... 271/146, 271/147, 210

See application file for complete search history.

(56) References Cited

U.S. PATENT DOCUMENTS

| | | | | |
|---|---|---|---|---|
| 3,545,741 | A * | 12/1970 | Porth | 270/58.1 |
| 5,346,203 | A | 9/1994 | Stemmle | |
| 6,032,004 | A | 2/2000 | Mirabella, Jr. et al. | |
| 6,286,827 | B1 * | 9/2001 | Meetze et al. | 271/162 |
| 6,585,253 | B1 | 7/2003 | Miki | |
| 6,848,688 | B1 | 2/2005 | Ruthenberg et al. | |
| 6,945,527 | B2 * | 9/2005 | Guddanti et al. | 271/147 |

FOREIGN PATENT DOCUMENTS

| | | |
|---|---|---|
| GB | 731460 | 12/1951 |
| GB | 1073089 | 12/1964 |
| JP | 52-017025 | 2/1977 |
| JP | 6-100179 | 4/1994 |
| JP | 8-002700 | 1/1996 |
| JP | 2001-002257 | 1/2001 |
| JP | 2006-219259 | 8/2006 |

* cited by examiner

*Primary Examiner*—David H Bollinger
(74) *Attorney, Agent, or Firm*—Gibb I.P. Law Firm, LLC

(57) ABSTRACT

A media tray has at least a bottom and two sides positioned along edges of the bottom. The media tray is adapted to hold sheets of media. The bottom comprises openings, and projections extend through the openings in the bottom of the media tray. The projections comprise elongated structures having rounded or flattened ends. The projections extend through the openings enough to touch the bottom sheet of the sheets of media. At least one vibrating support structure is positioned on an opposite side of the bottom from the sheets of media (e.g., below the media tray). The support structure is connected to the projections in such a manner so as to vibrate the projections.

20 Claims, 5 Drawing Sheets

VARIABLE FREQUENCY TAMPERS FOR COATED STOCKS USED IN PAPER FEED TRAYS

BACKGROUND AND SUMMARY

Embodiments herein generally relate to printing device and media trays, and relate more specifically to a media tray with vibrating projections that help prevent multiple sheets from being drawn out of the media tray.

Coated and uncoated stocks of printing media (e.g., paper, transparencies, cardstock, plastic sheets, etc.) sometimes have an issue with sheet separation when being drawn from the media tray into the printing device. The chemical properties of the coatings on the media and the weight of the media stack make it very difficult for sheets to separate from each other. In addition, humidity creates more problems with certain types of media.

One conventional way to separate sheets with a vacuum feeder is to blow ambient or heated air into the side of the stack for initial lift and separation of sheets. Vacuum is applied to the feeder housing to acquire the uppermost sheet to the feed position by using a vacuum plenum that can have compound angled surfaces to bend or flex in a manner that should cause gaps in the lead edge of multiple acquired sheets. Air pressure directed into the gaps, created by the vacuum plenum, can provide the final separation technique.

The embodiments herein comprise complete printing devices, or simply single modules of a printing device (e.g., a single paper tray) and are specifically directed to electrostatographic and xerographic devices. Therefore, some embodiments herein comprise a complete printing device that includes a printing media transport adapted to move printing media within the apparatus, a printing media input positioned at a first end of the printing media transport and a printing media output position at a second end of the printing media transport. A marking station is positioned within the apparatus adjacent to the printing media transport, wherein the marking station is adapted to form print markings on the printing media.

Embodiments herein supply a module to the foregoing structure that comprises a media tray positioned at the printing media input. The printing device includes a media mover (such as a roller, vacuum belt, etc.) positioned adjacent the media tray and also includes a controller operatively connected to the support structure and to the media mover. The media tray is adapted to be positioned next to the media mover so as to allow the media mover to contact the top sheet of the sheets of media.

The media tray has at least a bottom and two sides positioned along edges of the bottom. The media tray is adapted to hold sheets of media. The bottom comprises openings, and projections (tampers) extend through the openings in the bottom of the media tray. The projections comprise elongated structures having rounded or flattened ends. The projections extend through the openings enough to touch the bottom sheet of the sheets of media. In some embodiments, the support structure is adapted to move the projections through the openings different distances depending upon characteristics of the sheets of media, as indicated by the controller.

Further, at least one vibrating support structure is positioned on an opposite side of the bottom from the sheets of media (e.g., below the media tray). The support structure is connected to the projections in such a manner so as to vibrate the projections. More specifically, the controller is operatively connected to the vibrating support structure, and the controller is adapted to activate the vibrating support structure concurrently with the media mover. Thus, the support structure is adapted to vibrate the projections sufficiently to transfer vibrations from the bottom sheet to the top sheet to aid the media mover in removing only the top sheet and not any sheets adjacent to the top sheet (such as the second sheet in the stack of media sheets). Further, in some embodiments, the support structure is adapted to simultaneously vibrate at least two of the support structures at different frequencies when activated by the controller.

The "support structure" mentioned above can actually be a single structure or many structures. For example, the support structure can comprise a single structure connected to all of the projections or a plurality of structures, each of which is connected to at least one of the projections. Additionally, the support structure can comprise a cam adapted to move the support structure in a vibrating pattern, a plurality of electric stepper motors, etc. The support structure is adapted to vibrate the projections sufficiently to transfer vibrations from the bottom sheet to the top sheet to aid the media mover in removing only the top sheet and not any sheets adjacent to the top sheet.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As discussed above, embodiments herein provide systems for printing devices and media trays, and relates more specifically to a media tray with vibrating projections that help prevent multiple sheets from being drawn out of the media tray.

Figure 7:
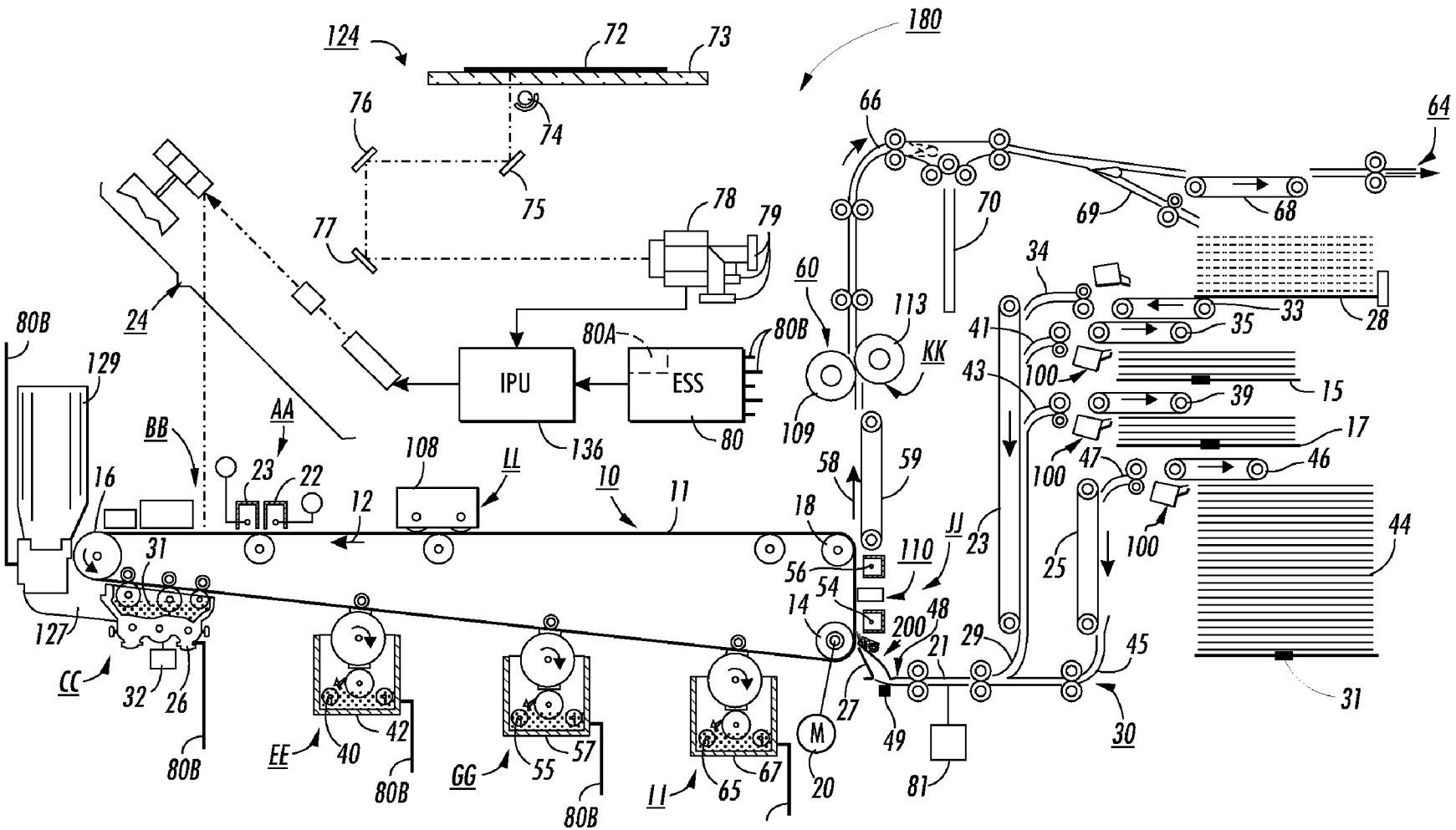
FIG. 7 is a cross-sectional schematic representation of an apparatus embodiment herein.

As discussed above, embodiments herein utilize a device that includes the ability to print and which may also be able to scan and perform processing on documents, communicate with remote entities, etc. There are many devices currently available that have these abilities, such as copiers, fax machines, multifunction printers, etc., and the embodiments herein are intended to operate with all such machines as well as other devices. The term "printing device" as used herein encompasses any such digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. Printers are readily available devices produced by manufactures such as Xerox Corporation, Stamford, Conn., USA. Such printers commonly include input/output, power supplies, processors, media movement devices, marking devices etc., the details of which are omitted herefrom to allow the reader to focus on the salient aspects of the embodiments described herein. FIG. 7 illustrates an exemplary device in which the module embodiments herein operate with high effectiveness.

More specifically, FIG. 7 illustrates an exemplary electrostatographic reproduction machine, for example, a multipass color electrostatographic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS).

The ESS is preferably a self-contained, dedicated minicomputer having a central processor unit (CPU), electronic storage, and a display or graphic user interface (GUI). The ESS is the control system which, with the help of sensors, and connections 80B as well as a pixel counter 80A, reads, captures, prepares and manages the image data flow between IPU 136 and image input terminal 124. In addition, the ESS 80 is the main multi-tasking processor for operating and controlling all of the other machine subsystems and printing operations. These printing operations include imaging, development, sheet delivery and transfer, and particularly control of the sequential transfer assist blade assembly. Such operations also include various functions associated with subsequent finishing processes. Some or all of these subsystems may have micro-controllers that communicate with the ESS 80.

The multipass color electrostatographic reproduction machine 180 employs a photoreceptor 10 in the form of a belt having a photoconductive surface layer 11 on an electroconductive substrate. The surface 11 can be made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separatism image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pretransfer corotron member negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units thus have their development functions turned off.

During the exposure and development of the last color separation image, for example by the fourth development unit 65, 67 a sheet of support material is advanced to a transfer station JJ by a sheet feeding apparatus 30. During simplex operation (single sided copy), a blank sheet may be fed from tray 15 or tray 17, or a high capacity tray 44 could thereunder, to a registration transport 21, in communication with controller 81, where the sheet is registered in the process and lateral directions, and for skew position. As shown, the tray 44 and each of the other sheet supply sources includes a sheet size sensor 31 that is connected to the controller 80. One skilled in the art will realize that trays 15, 17, and 44 each hold a different sheet type.

The speed of the sheet is adjusted at registration transport 21 so that the sheet arrives at transfer station JJ in synchronization with the composite multicolor image on the surface of photoconductive belt 10. Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

As shown, pretransfer baffles 27 guide the sheet from the registration transport 21 to transfer station JJ. Charge can be placed on the baffles from either the movement of the sheet through the baffles or by the corona generating devices 54, 56 located at marking station or transfer station JJ. Charge limiter 49 located on pretransfer baffles 27 and 48 restricts the amount of electrostatic charge a sheet can place on the baffles 27 thereby reducing image quality problems and shock hazards. The charge can be placed on the baffles from either the movement of the sheet through the baffles or by the corona generating devices 54, 56 located at transfer station JJ. When the charge exceeds a threshold limit, charge limiter 49 discharges the excess to ground.

Transfer station JJ includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10. A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10.

The transfer station JJ also includes the transfer assist blade assembly 200, in which various segmented blades are engaged for contacting the backside of the image receiving sheet. After transfer, the sheet continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multicolor toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof. The completed duplex copy exits to the finishing module (not shown) via output 64.

After the sheet of support material is separated from photoreceptor 10, the residual toner carried on the photoreceptor surface is removed therefrom. The toner is removed for example at cleaning station LL using a cleaning brush structure contained in a unit 108.

The embodiments herein comprise complete printing devices, such as the one shown in FIG. 7, or simply single modules of a printing device (e.g., a single paper tray 15, 17, or 44, for example) and are specifically directed to electrostatographic and xerographic devices. Therefore, embodiments herein can include a printing media transport 30 that moves the printing media within the apparatus, a printing media input 44 positioned at the first end of the printing media transport, and a printing media output 64 position at the second end of the printing media transport. A marking station JJ is positioned within the apparatus adjacent to the printing media transport and between the first and second ends of the printing media transport. The marking station is adapted to form print markings on the printing media.

Figure 1:
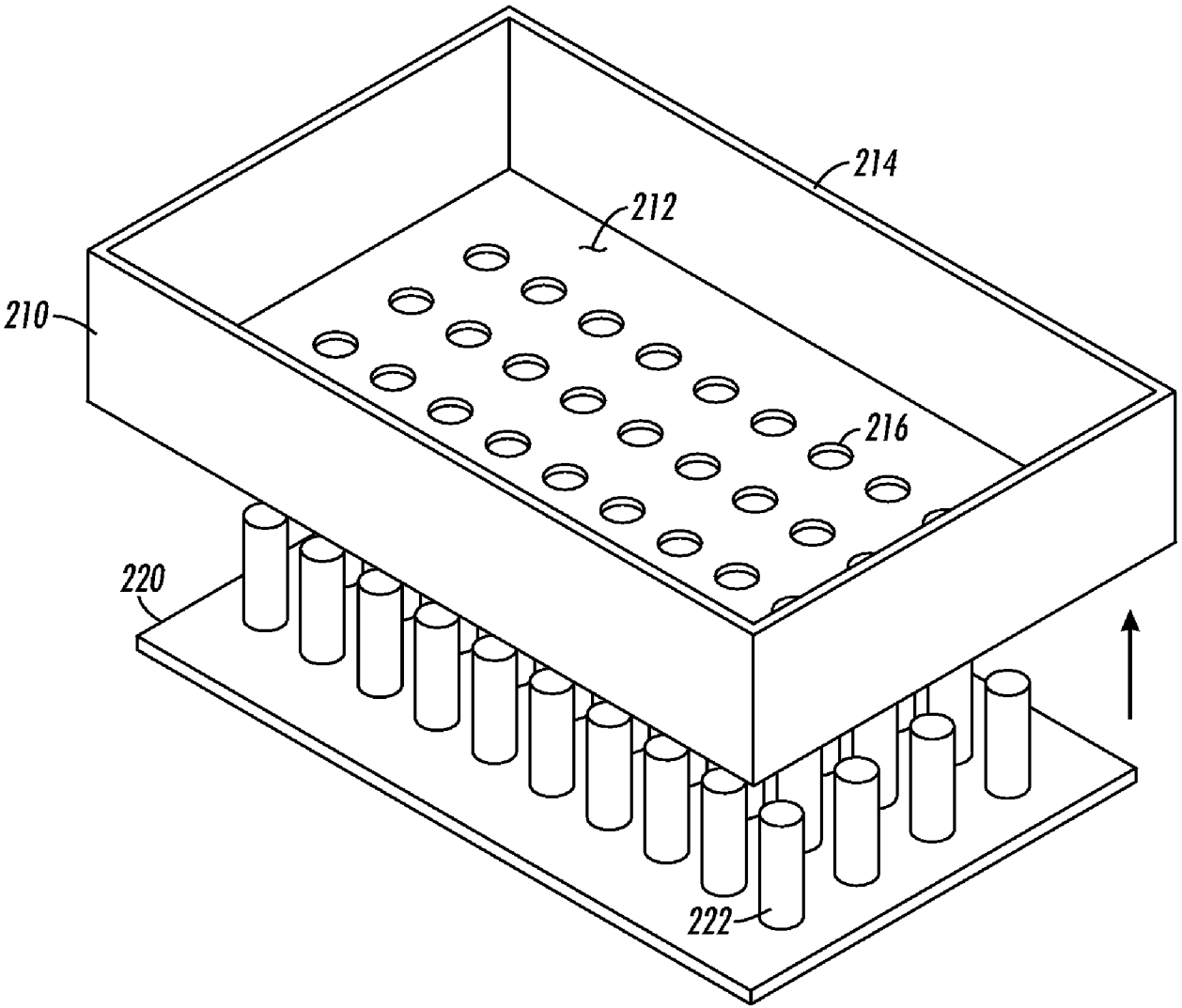
FIG. 1 is a perspective schematic representation of an apparatus embodiment herein.

FIGS. 1-6 illustrate the tray embodiments (individual module) in greater detail. More specifically, FIG. 1 illustrates a media tray 210 positioned at the printing media input. As mentioned above, the printing device includes a media mover 35, 39, 46 (such as a roller, vacuum belt, etc.) and associated heated air blowers 100 positioned adjacent the media tray 210 and also includes a controller ESS 80 operatively connected to the support structure and to the media mover. The media tray 210 is adapted to be positioned next to the media mover so as to allow the media mover to contact the top sheet of the sheets of media (as shown in FIG. 7).

Figure 5:
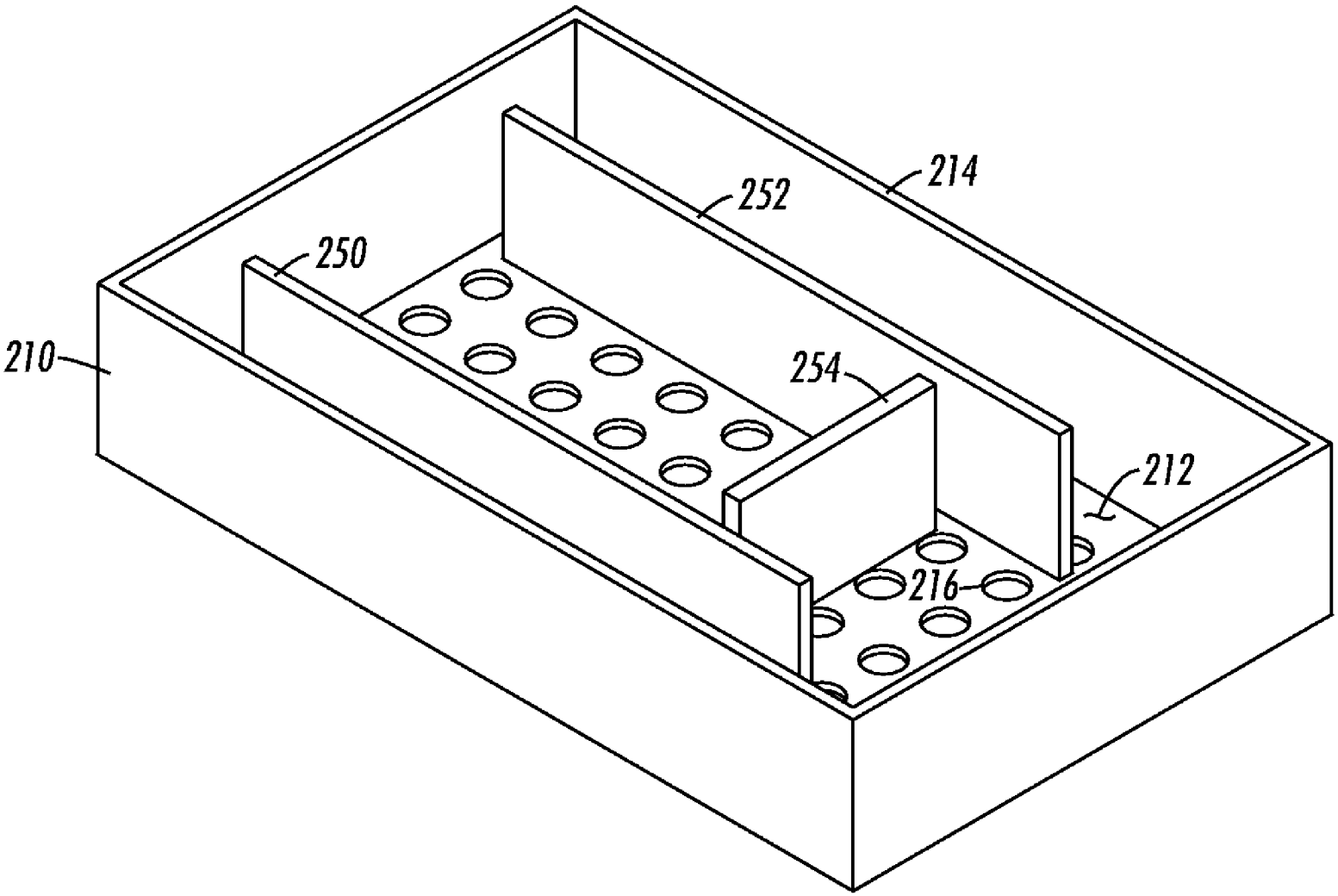
FIG. 5 is a perspective schematic representation of an apparatus embodiment herein.
Figure 6:
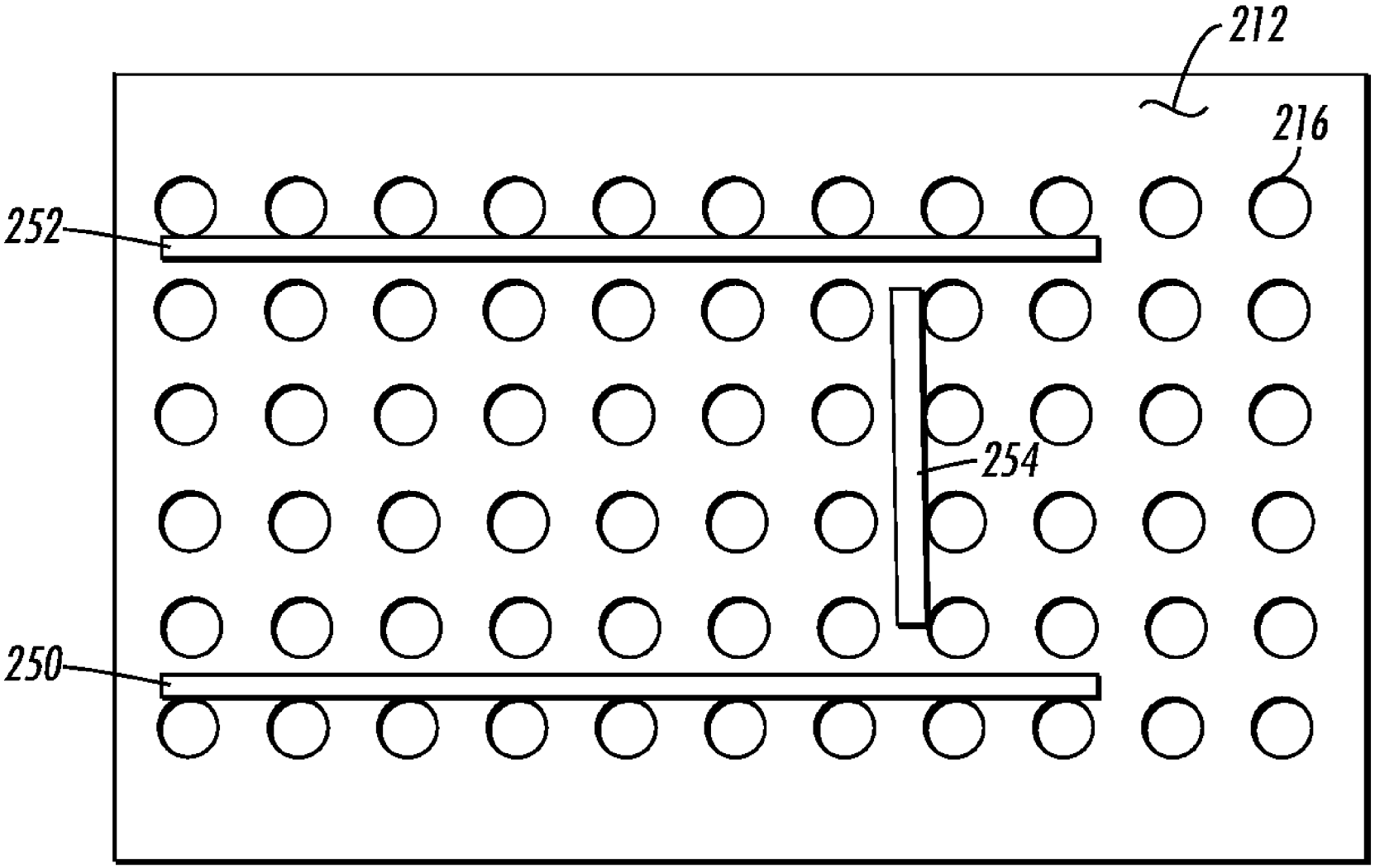
FIG. 6 is a top-view schematic representation of an apparatus embodiment herein.

The media tray 210 has at least a bottom 212 and two moveable or stationary sides 214 positioned along edges of the bottom 212 (although, as would be understood by those ordinarily skilled in the art, the tray could include three or four sides and a top, as well as many other features and structures, such as those illustrated in FIGS. 5 and 6). The media tray 210 is adapted to hold sheets of media as shown in FIG. 7. This form of media tray is intended to be operated approximately with the bottom 212 parallel to the ground so that the sheets rest. Mostly against the bottom 212 with the sides 214 being used for stack alignment.

If the sides 214 of the media tray 210 are not moveable, adjustable paper guides can be used. FIGS. 5 and 6 illustrate the adjustable paper guides 250, 252, 254 that can be included with embodiments herein that have fixed sides 214. In this example, center registered paper trays can have, for example, the three side guides 250, 252, 254 illustrated in FIGS. 5 and 6 to help control (maintain) the various papers in their proper positions. Therefore, with embodiments herein, if the projections 216 are bouncing or vibrating the media stack, the paper guides 250, 252, 254 can keep the paper in place while the paper is being separated and drawn in by the printing device.

Figure 2:
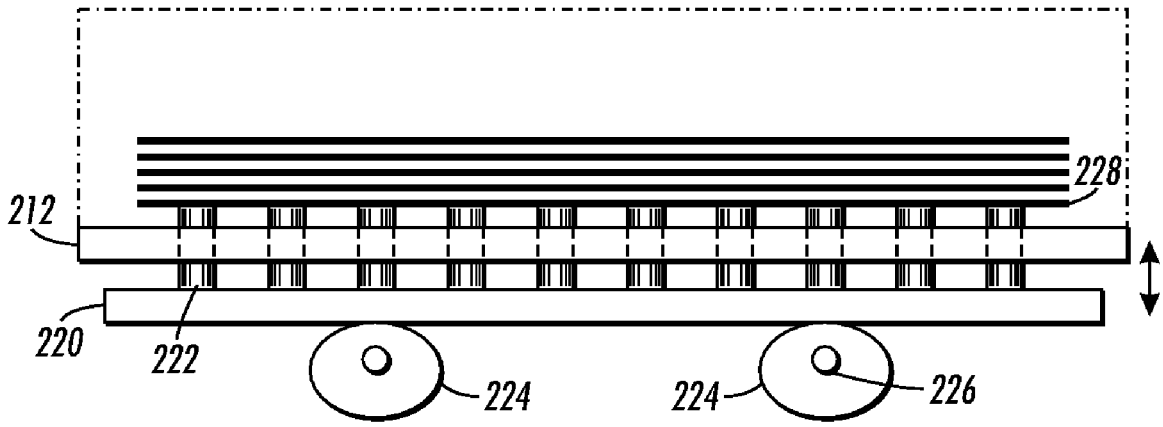
FIG. 2 is a cross-sectional schematic representation of an apparatus embodiment herein.
Figure 3:
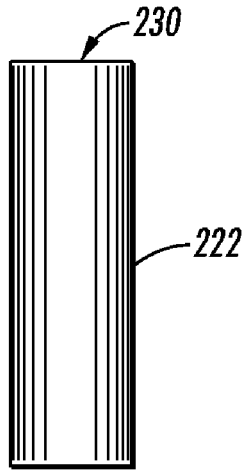
FIG. 3 is a cross-sectional schematic representation of an apparatus embodiment herein.
Figure 4:
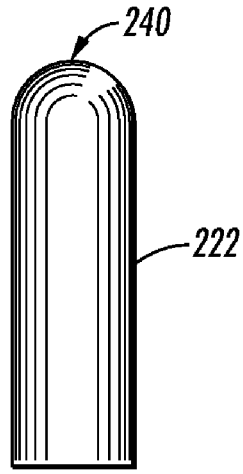
FIG. 4 is a cross-sectional schematic representation of an apparatus embodiment herein.

As shown in FIGS. 1 and 2, the bottom 212 comprises openings 216, and projections 222 that extend through the openings 216 in the bottom 212 of the media tray 210. The openings 216 can be regularly or irregularly spaced. The projections 222 can comprise any appropriately shaped structure, such as elongated structures having rounded ends 230 (FIG. 3) or flattened ends 240 (FIG. 4). As shown in the cross-sectional view in FIG. 2, the projections 222 extend through the openings 216 enough to touch the bottom sheet 228 of the stack of sheets of media. In some embodiments, the support structure 220 is adapted to be indexed up or down to move the projections 222 through the openings different distances to press against, or hit, the bottom of the stack harder (as shown by the arrow in FIG. 1) depending upon characteristics of the sheets of media, as indicated by the controller. Note that such indexing movement of one or all support structures is different and in addition to the up and down vibrational motion of the projections 222 that is caused by the cam or stepper motors.

In one embodiment, the projections 222 are positioned on the vibrating support structure 220. As shown in FIG. 2, the support structure 220 is positioned on an opposite side of the bottom 212 from the sheets of media 228 (e.g., below the media tray 210). The support structure 220 is connected to the projections 222 in such a manner so as to vibrate the projections 222 up and down (as shown by the double arrow in FIG. 2). More specifically, the controller 80 is operatively connected to the vibrating support structure 220, and the controller is adapted to activate the vibrating support structure 220 concurrently (simultaneously) with the media mover drawing (moving) the top media sheet.

Thus, the support structure 220 is adapted to vibrate the projections 222 sufficiently to transfer vibrations from the bottom sheet 228 to the top sheet to aid the media mover in removing only the top sheet and not any sheets adjacent to the top sheet (such as the second sheet in the stack of media sheets). Further, in some embodiments, the support structure 220 is adapted to simultaneously vibrate at least two of the support structures 220 at different frequencies when activated by the controller.

The "support structure" mentioned above can actually be a single structure or many structures. For example, the support structure 220 can comprise a single structure connected to all of the projections 222, as shown in FIG. 1. Alternatively, the support structure 220 can be connected to a limited number of the projections 222, as shown in FIG. 2, and a plurality of such support structures would be positioned below the bottom 212 of the tray 210. Additionally, the support structure 220 and projections 222 can move up and down with any elevator tray that supports and elevates the media tray 210.

Thus, the support structure 220 can actually comprise a plurality of structures, each of which is connected to at least one of the projections 222. Additionally, the support structure 220 can comprise one or more movement devices, such as cams or electrically actuated actuators or stepper motors (vibrators) 224 adapted to move the support structure 220 in a vibrating pattern. If multiple support structures are utilized, they can be vibrated at the same or different frequencies and/or some of the support structures can project farther above the bottom 212 of the tray 210 or project with more force when they are vibrating (e.g., to hit or vibrate (move) the media up more) relative to other support structures to further assist in the separation of the top sheet from the remaining sheets in the stack of sheets.

Alternatively, FIG. 1 can also illustrate a different embodiment having a non-vibrating support structure 220 upon which sit many individually actuated projections 222 (connected to and controlled by the controller) that comprise electrically controlled vibrators, each of which can vibrate at separate frequencies and/or with different amounts of force. Further, the support structure is adapted to move up and down (e.g., be indexed) to adjust the amount of pressure exerted on the bottom sheet by the vibrating projections 222.

Thus, as shown above, with embodiments herein projections or tampers are located under the elevator tray and move vertically (perpendicular to the paper). The radius tipped projections hit the bottom of the paper stack. By influencing the stack at a single location (or multiple locations) the cohesion between the sheets is disrupted. The tampers can also be indexed to different heights or positions for different media weights or different sizes or types of stocks.

While some conventional system vibrate the uppermost sheets within a paper tray (e.g., U.S. Pat. No. 6,585,253 and Japanese Patent Laid-Open Publication No. 6-100179, the complete disclosures of which are incorporated herein by reference) the present embodiments drive vibrations from the bottom of the stack of media sheets, which produces a number of unexpected benefits. More specifically, while conventional teachings logically apply the vibrational forces directly to the sheets that may be sticking to one another (e.g., directly to the sheets at the top of the media stack within the tray) by vibrating the rollers drawing the sheets or by applying vibrators to the top sheets, the present embodiments break away from such line of conventional teachings by providing a support structure that is adapted to vibrate the projections sufficiently to transfer vibrations from the bottom sheet to the top sheet to aid the media mover in removing only the top sheet (and not any sheets adjacent to the top sheet).

In other words, while it may be apparent to apply vibrations to locations that are as close as possible to the sheets that are actually sticking to one another in order to prevent the sheets from sticking to one another, it would not be apparent to intentionally apply such vibrational forces at locations that are farther away from the locations where the sheets are sticking to one another because moving such forces away would (according to conventional logic) reduce their effectiveness. However, the present embodiments have produced a number of unexpected benefits (e.g., increasing sheet separation) by not following such conventional logic and by moving the vibrational forces away from the top of the stack of sheets.

One of the unexpected benefits of applying vibrational force to the bottom of the stack of sheets in the tray is that the entire stack of sheets is forced to vibrate up and down, which unexpectedly causes the top few sheets to also move up and down while the very top sheet is being drawn from the tray. This up and down movement unexpectedly helps move the second sheet downward from the top sheet while the top sheet is being drawn upward or sideways by the media mover that removes the sheets from the tray.

Further, by vibrating the different projections differently (at different frequencies and/or by moving the projections different linear distances through the openings in the bottom of the tray during the vibration process) an irregular up and down movement is transmitted to the top few sheets, which applies irregular forces to the areas of the sheets that may be sticking, which also unexpectedly helps to separate the top few sheets.

Also, in some embodiments, the support structure is adapted to move the projections through the openings different distances depending upon characteristics of the sheets of media (thickness, surface friction, moisture content, etc.) as indicated by the controller. The amount by which the projections extend through the openings (amount by which they are indexed) alters the force applied to the stack of sheets. Therefore, the present embodiments have the ability to apply different vibrational forces to different types of media having different characteristics, which is advantageous because some types of print media may require greater or lesser forces for proper separation. The information regarding the media sheets being supplied to the printing device can be automatically determined by the printing device or manually entered by the user. The printing device can determine the paper size by the position of the side guides, for example. On other printing devices, the customer inputs the media weight/type that is being feed, so that the embodiments herein can index the projections based on the specific characteristics of the media being used.

Thus, with embodiments herein multiple cam indexed or stepper motor driven projections are located under the elevator tray. The projections hit the bottom of the paper stack. By impacting the stack at a single or multiple locations, the cohesion between the sheets is disturbed. The projections can be indexed to different heights for different media weights or for different sizes of stocks. The projections can also be vibrated at different speeds to create different vibration effects. The projections could be set so as to not vibrate (e.g., turned off) if stocks of media that do not experience sticking problems were being utilized.

The present embodiments can eliminate or reduce the need for expensive heaters 100 (and the additional voltages required to run such heaters) which is useful because the use of heat on some papers dries out the paper in localized areas which can cause marking issues. Further, the embodiments herein can reduce the blower size that is required today by reducing the amount of air pressure that is required to separate the sheets.

All foregoing embodiments are specifically applicable to electrostatographic and/or xerographic machines and/or processes as well as to software programs stored on the electronic memory 80 (computer usable data carrier) and to services whereby the foregoing methods are provided to others for a service fee. It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. An apparatus comprising:

a media tray comprising a bottom and at least two sides positioned along edges of said bottom, wherein said bottom comprises openings, and wherein said media tray is adapted to hold sheets of media;

projections extending through said openings in said bottom of said media tray, wherein said projections extend through said openings enough to touch a bottom sheet of said sheets of media; and at least one vibrating support structure positioned on an opposite side of said bottom from said sheets of media, wherein said support structure is connected to said projections in such a manner so as to vibrate said projections, wherein said media tray is adapted to be positioned next to a media mover so as to allow said media mover to contact a top sheet of said sheets of media, wherein said media mover is operatively connected to a controller, wherein said controller is operatively connected to said vibrating support structure, and wherein said controller is adapted to activate said vibrating support structure concurrently with said media mover.

2. The apparatus according to claim 1, all the limitations of which are incorporated herein by reference, wherein said support structure comprises one of:

a single structure connected to all of said projections; and a plurality of structures, each of which is connected to at least one of said projections.

3. The apparatus according to claim 1, all the limitations of which are incorporated herein by reference, wherein said support structure comprises one of:

a cam adapted to move said support structure in a vibrating pattern; and a plurality of electric stepper motors.

4. The apparatus according to claim 1, all the limitations of which are incorporated herein by reference, wherein said support structure is adapted to vibrate said projections sufficiently to transfer vibrations from said bottom sheet to said top sheet to aid said media mover in removing only said top sheet and not any sheets adjacent to said top sheet.

5. The apparatus according to claim 1, all the limitations of which are incorporated herein by reference, wherein said projections comprise elongated structures having one of rounded and flattened ends.

6. An apparatus comprising:

a media tray comprising a bottom and at least two sides positioned along edges of said bottom, wherein said bottom comprises openings, and wherein said media tray is adapted to hold sheets of media;

projections extending through said openings in said bottom of said media tray, wherein said projections extend through said openings enough to touch a bottom sheet of said sheets of media; and vibrating support structures positioned on an opposite side of said bottom from said sheets of media, wherein said support structure is connected to said projections in such a manner so as to vibrate said projections, wherein said media tray is adapted to be positioned next to a media mover so as to allow said media mover to contact a top sheet of said sheets of media, wherein said media mover is operatively connected to a controller, wherein said controller is operatively connected to said vibrating support structure, wherein said controller is adapted to activate said vibrating support structure concurrently with said media mover, and wherein said support structure is adapted to simultaneously vibrate at least two of said support structures at different frequencies when activated by said controller.

7. The apparatus according to claim 6, all the limitations of which are incorporated herein by reference, wherein said support structure comprises one of:

a single structure connected to all of said projections; and a plurality of structures, each of which is connected to at least one of said projections.

8. The apparatus according to claim 6, all the limitations of which are incorporated herein by reference, wherein said support structure comprises one of:

a cam adapted to move said support structure in a vibrating pattern; and a plurality of electric stepper motors.

9. The apparatus according to claim 6, all the limitations of which are incorporated herein by reference, wherein said support structure is adapted to vibrate said projections sufficiently to transfer vibrations from said bottom sheet to said top sheet to aid said media mover in removing only said top sheet and not any sheets adjacent to said top sheet.

10. The apparatus according to claim 6, all the limitations of which are incorporated herein by reference, wherein said projections comprise elongated structures having one of rounded and flattened ends.

11. An apparatus comprising:

a media tray comprising a bottom and at least two sides positioned along edges of said bottom, wherein said bottom comprises openings, and wherein said media tray is adapted to hold sheets of media;

projections extending through said openings in said bottom of said media tray, wherein said projections extend through said openings enough to touch a bottom sheet of said sheets of media; and vibrating support structures positioned on an opposite side of said bottom from said sheets of media, wherein said support structure is connected to said projections in such a manner so as to vibrate said projections, wherein said media tray is adapted to be positioned next to a media mover so as to allow said media mover to contact a top sheet of said sheets of media, wherein said media mover is operatively connected to a controller, wherein said controller is operatively connected to said vibrating support structure, wherein said controller is adapted to activate said vibrating support structure concurrently with said media mover, and wherein said support structure is adapted to move said projections through said openings different distances depending upon characteristics of said sheets of media, as indicated by said controller.

12. The apparatus according to claim 11, all the limitations of which are incorporated herein by reference, wherein said support structure comprises one of:

a single structure connected to all of said projections; and a plurality of structures, each of which is connected to at least one of said projections.

13. The apparatus according to claim 11, all the limitations of which are incorporated herein by reference, wherein said support structure comprises one of:

a cam adapted to move said support structure in a vibrating pattern; and a plurality of electric stepper motors.

14. The apparatus according to claim 11, all the limitations of which are incorporated herein by reference, wherein said support structure is adapted to vibrate said projections sufficiently to transfer vibrations from said bottom sheet to said top sheet to aid said media mover in removing only said top sheet and not any sheets adjacent to said top sheet.

15. The apparatus according to claim 11, all the limitations of which are incorporated herein by reference, wherein said projections comprise elongated structures having one of rounded and flattened ends.

16. A printing device comprising:

a printing media transport adapted to move printing media within said printing device;

a printing media input positioned at a first end of said printing media transport;

a printing media output position at a second end of said printing media transport;

a marking station positioned within said printing device adjacent to said printing media transport, wherein said marking station is adapted to form print markings on said printing media;

a media tray positioned at said printing media input comprising a bottom and at least two sides positioned along edges of said bottom, wherein said bottom comprises openings, and wherein said media tray is adapted to hold sheets of media;

projections extending through said openings in said bottom of said media tray, wherein said projections extend through said openings enough to touch a bottom sheet of said sheets of media;

at least one vibrating support structure positioned on an opposite side of said bottom from said sheets of media, wherein said support structure is connected to said projections in such a manner so as to vibrate said projections;

a media mover positioned adjacent said media tray; and a controller operatively connected to said support structure and to said media mover, wherein said media tray is adapted to be positioned next to said media mover so as to allow said media mover to contact a top sheet of said sheets of media, wherein said controller is operatively connected to said vibrating support structure, and wherein said controller is adapted to activate said vibrating support structure concurrently with said media mover.

17. The printing device according to claim 16, all the limitations of which are incorporated herein by reference, wherein said support structure comprises one of:

a single structure connected to all of said projections; and a plurality of structures, each of which is connected to at least one of said projections.

18. The printing device according to claim 16, all the limitations of which are incorporated herein by reference, wherein said support structure comprises one of:

a cam adapted to move said support structure in a vibrating pattern; and a plurality of electric stepper motors.

19. The printing device according to claim 16, all the limitations of which are incorporated herein by reference, wherein said support structure is adapted to vibrate said projections sufficiently to transfer vibrations from said bottom sheet to said top sheet to aid said media mover in removing only said top sheet and not any sheets adjacent to said top sheet.

20. The printing device according to claim 16, all the limitations of which are incorporated herein by reference, wherein said marking device comprises one of an electrostatographic device and a xerographic device.

* * * * *